US005979003A

United States Patent [19]

Billat

[11] Patent Number: 5,979,003

[45] Date of Patent: Nov. 9, 1999

[54] DEVICE FOR CLEANING PANES OF GLASS, PIECES OF FURNITURE AND SIMILAR ARTICLES

[76] Inventor: Alain Edouard Billat, 16 rue Michel Blere, Lamorlaye, France, 60260

[21] Appl. No.: 09/102,978

[22] Filed: Jun. 22, 1998

[30] Foreign Application Priority Data

Apr. 14, 1998 [FR] France ..... 98 04632

[51] Int. Cl.[6] ..... A47L 1/08

[52] U.S. Cl. ..... 15/104.94; 15/220.1; 15/210.1

[58] Field of Search ..... 15/210.1, 220.1, 15/229.11, 244.1, 244.4

[56] References Cited

U.S. PATENT DOCUMENTS 3,388,415 6/1968 Warner et al. ..... 15/210.1
4,852,203 8/1989 LaBelle ..... 15/210.1
5,095,574 3/1992 Khanzadian ..... 15/220.1
5,603,138 2/1997 Bonis ..... 15/220.1
5,657,507 8/1997 Wasak ..... 15/104.94
5,791,801 8/1998 Miller .

*Primary Examiner*—Terrence R. Till
*Attorney, Agent, or Firm*—Robert W. Becker & Associates

[57] ABSTRACT

The device comprises a first and a second face. The first face is provided with at least one layer of absorbing material and the second face is provided with a handling means. The layer of absorbing material is a layer of felted polyurethane foam operatively associated with at least one underlying layer of hydrophilic material that is constantly and regularly impregnated with a cleaning liquid which is retained in the layer of felted polyurethane foam.

14 Claims, 1 Drawing Sheet

DEVICE FOR CLEANING PANES OF GLASS, PIECES OF FURNITURE AND SIMILAR ARTICLES

FIELD OF THE INVENTION

This invention essentially relates to a device enabling a particularly fast and effective cleaning of panes of glass, pieces of furniture and all similar articles comprising surfaces to be cleaned from time to time.

The device of the invention finds a particularly advantageous application in the cleaning of building or vehicle panes of glass.

Users of automobile vehicles know perfectly the inconveniences caused by the fatty film that is formed on the inside portion of vehicle panes of glass after a certain time. This film is in fact known in the art as "fogging".

The fogging results from chemical deposits from plastic material fittings inside the vehicle as well as from outside polluting gases, in particular exhaust gases spread in the vehicle by the ventilating apertures thereof. This fogging film is still emphasized in vehicles, the passengers of which are smokers.

At present, cleaning is more often made with help of a sprayer of liquid cleaning products which are spread on the panes of glass and then wiped off with a rag. The spray of cleaning products will often extend beyond the surfaces to be cleaned, and will fall in particular on the instrument panal, so that it becomes necessary to clean not only the pane of glass of the windshield but also the instrument panel itself.

Moreover, even after a diligent and often cumbersome cleaning, there still remains on the pane of glass some traces of fogging, in particular in spots that are difficult to access, such as, for example, in corners of this pane of glass.

SHORT DESCRIPTION OF THE KNOWN ART

To solve the problems due to cleaning of a surface after a prior spraying of a liquid product on the surface to be cleaned, it has been proposed to use cleaning pads essentially comprising a rigid plate having two faces, with one face being provided with one or a plurality of layers of absorbing material able to retain a cleaning liquid product, while the other face of the plate comprises a handling means for enabling a user to hold and maneuver the cleaning pad.

However, such a cleaning system is far from being satisfactory. Actually, very often, it does not always permit an effective cleaning of an article, like a pane of glass, in spots that are difficult to access. Moreover, even after a careful cleaning, the liquid and now dirty product will spread more or less on the pane of glass, and it always remains some traces or iridescence which are dangerous, particularly on automobile vehicle panes of glass when driving the vehicle at night, since they can dazzle the driver of the vehicle.

PURPOSE AND SUMMARY OF THE INVENTION

Therefore, the present invention has particularly for its purpose to cope with the hereinabove mentioned problems by providing an improved device which enables a cleaning of a pane of glass or similar article comprising one or a plurality of surfaces to be cleaned, the cleaning operation being then easily made and without effort, with a minimum of passes, on the entire surface to be cleaned, and avoiding advantageously, after the cleaning operation, to leave on this surface some traces of dirty marks spread by the device on the surface.

For this purpose, the invention relates to a device for cleaning panes of glass, pieces of furniture and similar articles, of the type comprising a rigid or semirigid plate having a first and a second face, the first face being provided with at least one layer of absorbing material and the second face being provided with a handling means, wherein the layer of absorbing material is a layer of felted polyurethane foam, this layer of absorbing material being operatively associated with at least one underlying layer of hydrophilic material that is constantly and regularly impregnated with a cleaning liquid which is retained in the layer of felted polyurethane foam.

According to a preferred embodiment, the underlying layer of hydrophilic material is a perforated voile of viscose, and the perforated voile of viscose is a non-woven material of a weight equal to about 75 g/m$^2$.

To this voile of viscose is associated an underlying voile of polyester.

This voile of polyester is preferably a non-woven material of a weight equal to about 25 g/m$^2$.

The device of this invention is also characterized in that the above mentioned plate has substantially the shape of a triangle with corners that are more or less rounded or acute.

The sides of the triangle may be slightly convex.

According to another feature of the invention, the above mentioned handling means is a pommel that is preferably positioned near one of the corners of the triangle formed by the plate.

According to still another feature of the invention, the layer of absorbing material is glued or soldered on the above mentioned plate, while the voile of viscose and the voile of polyester form a unit covering the plate.

This unit may therefore advantageously be disposable and replaceable.

According to another feature of the invention, the pommel and the plate are made of a different synthetic material and are fixed together by any suitable means, such as for example fusing or glueing.

It will also be noted here that the face of the plate which carries the pommel is provided with a lengthened recess beginning at a connection of the pommel with the plate.

Thus, the device can be better held in one hand of a user and better controlled during a cleaning operation, due to the fact that the user will be able to apply one finger of his (or her) hand in the above mentioned recess.

However various other benefits and features of the invention will moreover be revealed from the following detailed description.

BRIEF DESCRIPTION OF THE DRAWINGS

An embodiment of the invention is shown, as a non limitative example, in the accompanying drawings, wherein.

DESCRIPTION OF THE PREFERRED EMBODIMENT

Figure 1:
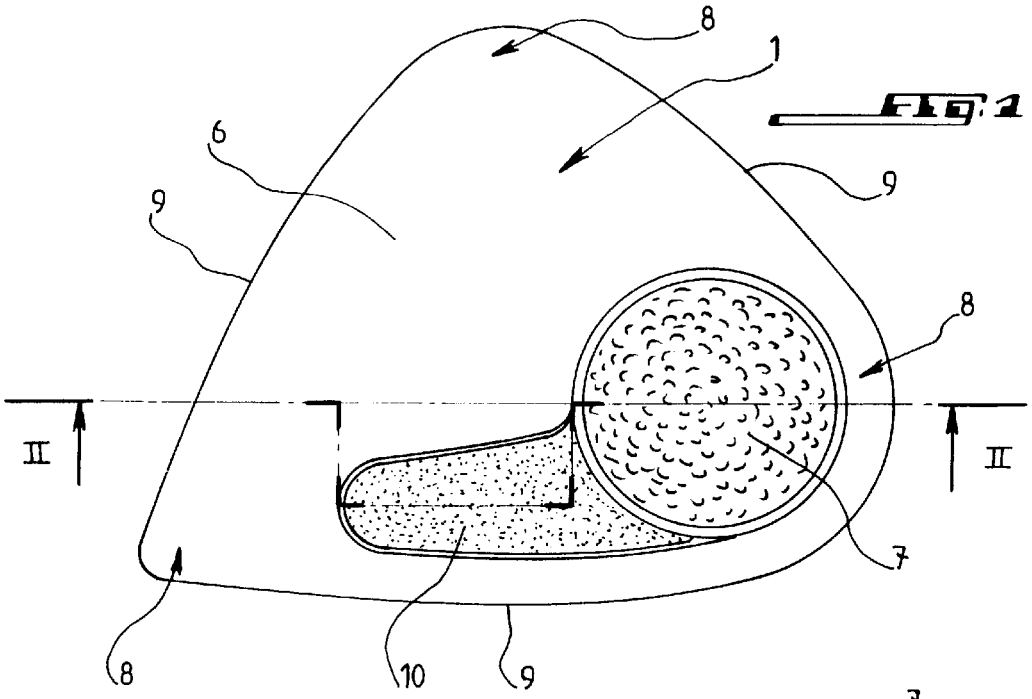
FIG. 1 is a top plan view of the cleaning device of this invention.

According to one embodiment of the invention, and as shown in the drawings, a cleaning device according to this invention comprises essentially a plate 1 of a rigid or semi-rigid material on one face 2 of which are fixed, in a superimposed and successive manner, a layer 3 of absorbing material, an underlying layer 4 of hydrophilic material, and a voile 5 of polyester.

These superimposed members will be hereinafter described in detail together with their respective benefits and in combination with the other members.

The plate 1 itself is made of a slightly flexible rigid or semi-rigid material, for example a plastic material of the polystyrene or similar type.

The plate 1 comprises, on its face 6 opposite the face 2 carrying the successive layers 3, 4 and 5, a pommel 7 forming so to speak a handling and maneuvering means for the cleaning device of this invention formed by the assembly of the plate 1 and layers 3, 4 and 5.

Figure 2:
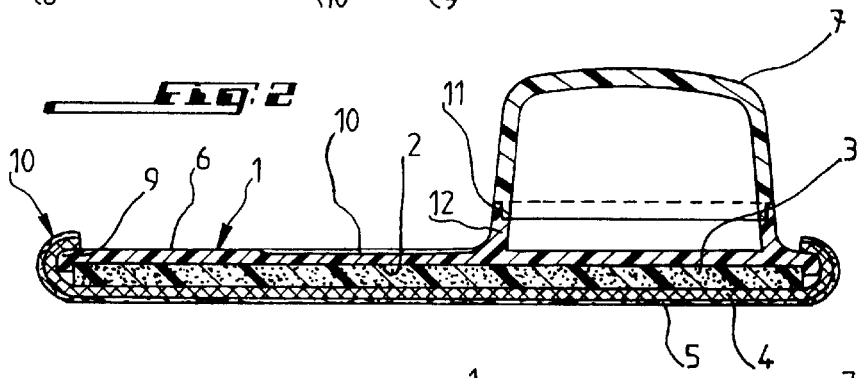
FIG. 2 is a cross-sectional view of the cleaning device taken along line II-II of FIG. 1.

According to the illustrated embodiment and as better shown in FIG. 2, the pommel 7 and the plate 1 form two parts made of a different synthetic material. Then, the plate 1 may be, as previously mentioned, made of polystyrene, while the pommel 7 may be made of another synthetic material and may comprise on its surface some protrusions or recesses for forming therefore a better grasping surface for ensuring a better handling by one hand of a user. As it is also seen from FIG. 2, the pommel 7 and the plate 1 are fixed together by means of a shoulder 11 between the pommel 7 and a chimney like part 12 protruding from the face 6 of the plate 1. The fixation at the shoulder 11 may be made by any suitable means, such as for example glueing, fusing or an other technique.

Obviously, the pommel 7 and the plate 1 could perfectly, without departing from the scope of the invention, form a unitary part made, for example, by injection moulding.

There has been shown at 10 an elongate depression or recess provided in the face 6 of the plate 1. The recess 10 begins at a connection of the pommel 7 with the plate 1, as this is clearly shown in the figures. The recess 10 may advantageously receive the index finger of one hand of the user who holds the pommel 7, and consequently facilitates using the device of the invention and maneuvering it on the surface to be cleaned. It will still be noted that recess 10 comprises protrusions for preventing the index finger of the hand of the user to slide in said recess.

Moreover, the plate 1, as this is clearly shown in the drawings, has substantially the shape of a triangle having corners 8 which can be more or less rounded or acute. Also, some corners of the triangle forming the plate 1 can be more rounded than other corners, as this is well shown in FIG. 1, the above mentioned pommel 7 being positioned, according to the embodiment as shown, near from one of the corners of the triangle forming the plate 1.

It will also be noted that the sides 9 of the triangle forming the plate 1 are slightly convex.

Figure 3:
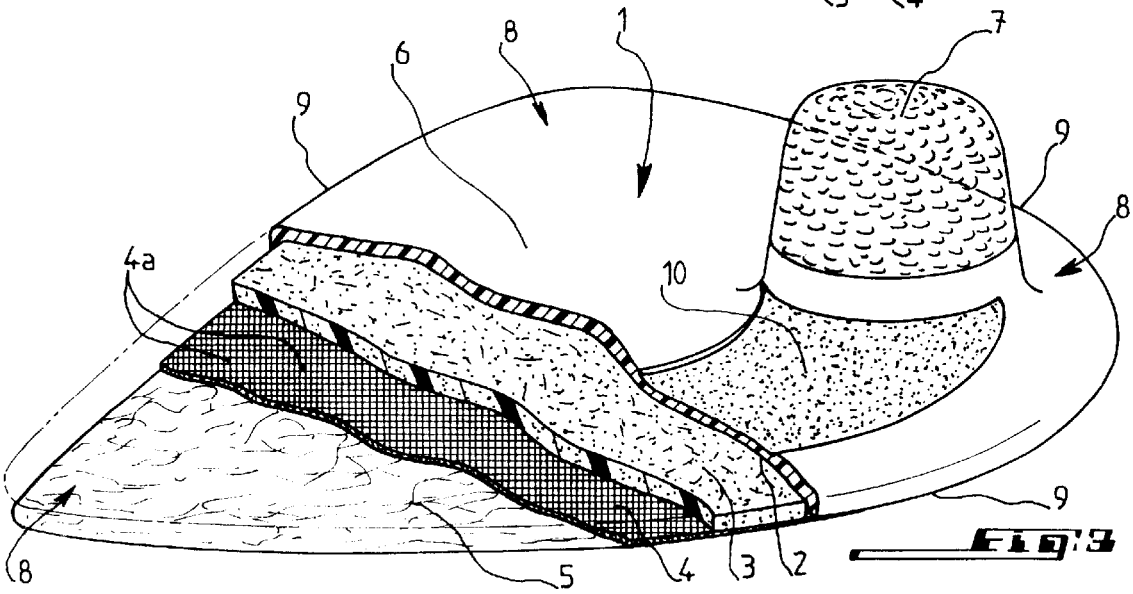
FIG. 3 is a perspective view of the cleaning device with a partial cut away of the plate and of the successive layers that forms it.

The plate 1 enables, in a general manner, to ensure a uniform pressure on the surfaces to be cleaned (vehicle panes of glass, or shop windows, for example) which is a condition, between others, for a good cleaning effectiveness. Moreover, if the plate 1 is semi-rigid, the plate 1 can closely follow the curvatures of the panes of glass to be cleaned, which is particularly valuable for the inner surface of vehicle wind-shields, being in particular noted that one of the corners 8 of the plate 1 may be less rounded than the other corners, as this is shown on the left part of FIGS. 1 and 3, in order to permit an effective cleaning in the corners. Obviously, modifications of the shape and size of the plate 1 can perfectly be provided according to a proposed application of the device, without departing from the scope of the invention.

The layer 3 of absorbing material is fixed by glueing or fusing on the face 2 of the plate 1.

This layer 3 is preferably a layer of felted polyurethane foam which is used as a reservoir and which has the advantage to absorb a certain amount of cleaning liquid, which cleaning liquid may not be totally recovered when a pressure is exerted on this layer. The layer 3 of felted polyurethane foam may be preimpregnated with cleaning liquid, or it could be impregnated with this liquid only upon use of the device.

The layer 3 is preferably a layer of cross-linked foam of polyurethane with a completely open cellular network, of a type known under the trademark BULPREN. The layer 3 made of such a material may have a thickness comprised between about 2 and 10 mm.

The underlying layer 4 of hydrophilic material will be formed by a perforated voile of viscose. Perforations of this voile of viscose 4 are diagrammatically shown at 4*a*.

The perforated voile of viscose 4 is preferably a non-woven material of a weight equal to about 75 g/m$^2$, of a type known under the trademark NORAFIN. Such a perforated voile 4 has the advantage to be self absorbing, diffusing and collecting of dirt due to the presence of perforations 4*a* in the voile 4.

More precisely, this voile 4 cooperates advantageously with the absorbing layer 3 of felted polyurethane foam, as it works similarity as an absorbing wick for the cleaning liquid in said layer, so that the voile 4 remains constantly and regularly impregnated with the cleaning liquid retained in the layer 3. In other words, the voile of viscose 4 has a regulating role since, by trying to permanently achieve a maximum saturation, the voile 4 re-equilibrates its impregnation by wicking from the reservoir forming layer 3, the liquid which has been taken-off due to the cleaning operation.

The voile of polyester 5, which is thinner than the layer of absorbing material 3 or even than the voile of viscose 4, is composed, generally, of loosely agglomerated long fibers and is therefore permeable by the cleaning liquid.

The voile of polyester 5 may be of a type known under the trademark LUTRAVIL, and is a non-woven material having preferably a weight equal to about 25 g/m$^2$. It has the advantage to be relatively rigid and to have abrasive properties, while it is relatively permeable to the cleaning liquid.

Because of its texture, the voile of polyester 5, beside the fact that it gives to the device a good sliding effect on the surface to be cleaned, has also the advantage to slightly scratch the dirt from this surface, and above all to retain, in apertures of the voile 5, the dirt that has been dissolved in the non-evaporated cleaning liquid.

It should also be noted here that, according to the invention, the voile of viscose 4 and the voile of polyester 5 may form a pre-assembled unit which can be mounted on the layer 3 of felted polyurethane foam, and this while covering the plate 1. More precisely, as this is better shown in FIG. 2, the edge 10 of the unit formed by the two voiles 4 and 5 is bent over for covering the side 9 of the triangle delimiting the rigid or semi-rigid plate 1.

Thus, the unit formed by the two voiles 4 and 5, when it will be more or less saturated with dirt, will be able to be advantageously discarded and easily replaced by a new clean unit.

It will perfectly be possible, without departing from the scope of the invention, to embody the voiles 4 and 5 inseparable from the device, in particular to make them initially integral with the device and inseparable therefrom.

The above description shows that there has been made, according to the invention, a cleaning device that is particularly effective for panes of glass, in particular, and this with a minimum pressure effort on the surface to be cleaned and with a number minimal of scrubbing passes, being also noted that, because of the particular geometry of the device, it is easy to reach the corners to be cleaned, and no traces of vapor and/or residual dirt etc. will be presented after the cleaning operation due to the specific combination of the various layers forming the device of the invention and which remain regularly, homogeneously and constantly moistened with cleaning liquid.

Obviously, the invention is not limited to the embodiment as above described and shown, which embodiment has only been given as an example.

Therefore, the handling pommel 7 can possibly be a hollow pommel, and advantageously form a reservoir for cleaning liquid in contact with the layer of absorbing material.

It is therefore obvious that the invention comprises all technical equivalents of the above described means, as well as the combinations thereof if they are made according to the scope of the invention as shown in the following claims.

What is claimed is:

1. A cleaning device for cleaning surfaces, said device comprising:

a rigid or semi-rigid plate (1) having a first face (2) and a second face (6);

an absorbent material layer (3) having opposed first and second sides and connected with said first side to said first face (2);

said absorbent material layer (3) comprised of felted polyurethane foam and, when using said cleaning device, is filled with a cleaning liquid;

a handling means (7) connected to said second face (6);

a hydrophilic material layer (4) connected to said second side of said absorbent material layer (3);

said hydrophilic material layer (4) adapted to continuously wick the cleaning liquid from said absorbent material layer (3).

2. A cleaning device according to claim 1, wherein said hydrophilic material layer (4) is a perforated viscose voile.

3. A cleaning device according to claim 2, wherein said perforated viscose voile is a non-woven material and weighs 75 g/m$^2$.

4. A cleaning device according to claim 1, further comprising a layer (5) of polyester voile connected to said hydrophilic material layer (4) remote from said absorbent material layer (3).

5. A cleaning device according to claim 4, wherein said polyester voile is a non-woven material and weighs 25 g/m$^2$.

6. A cleaning device according to claim 1, wherein said plate (1) is triangular and has at least one rounded corner (8).

7. A cleaning device according to claim 6, wherein said plate (1) has convex sides (9).

8. A cleaning device according to claim 1, wherein said plate (1) is triangular and has a pointed corner (8).

9. A cleaning device according to claim 8, wherein said plate (1) has convex sides (9).

10. A cleaning device according to claim 1, wherein said handling means is a pommel (7), said plate (1) is triangular, and said pommel (7) is positioned near a corner of said plate (1).

11. A cleaning device according to claim 1, further comprising a layer (5) of polyester voile connected to said hydrophilic material layer (4) remote from said absorbent material layer (3), wherein said absorbent material layer (3) is glued onto said plate (1), wherein said hydrophilic material layer (4) is comprised of a perforated viscose voile, and wherein said layer (5) of polyester voile and said perforated viscose voile (4) form an integral unit covering said absorbent material layer (3) and edges of said plate (1).

12. A cleaning device according to claim 1, further comprising a layer (5) of polyester voile connected to said hydrophilic material layer (4) remote from said absorbent material layer (3), wherein said absorbent material layer (3) is fused onto said plate (1), wherein said hydrophilic material layer (4) is comprised of a perforated viscose voile, and wherein said layer (5) of polyester voile and said perforated viscose voile (4) form an integral unit covering said absorbent material layer (3) and edges of said plate (1).

13. A cleaning device according to claim 1, wherein said pommel (7) and said plate (1) are made of different materials and are connected to one another by fusing or gluing.

14. A cleaning device according to claim 1, wherein said second face (6) has an elongate recess (10), wherein said handling means is a pommel (7), and wherein said recess (10) begins at said pommel (7) and extends away from said pommel (7).

* * * * *